US006210475B1

(12) United States Patent
Dauplaise et al.

(10) Patent No.: US 6,210,475 B1
(45) Date of Patent: Apr. 3, 2001

(54) USE OF HYDROXYALKYLATED STARCHES FOR IMPROVED EMULSIFICATION OF SIZING AGENTS

(75) Inventors: David L. Dauplaise, Stamford; Robert Joseph Proverb, Danbury; Katarzyna Komarowska, Milford, all of CT (US)

(73) Assignee: Bayer Corporation, Pittsburgh, PA (US)

( * ) Notice: Subject to any disclaimer, the term of this patent is extended or adjusted under 35 U.S.C. 154(b) by 0 days.

(21) Appl. No.: 09/389,701

(22) Filed: Sep. 3, 1999

(51) Int. Cl.[7] ..... C09D 103/08; C09D 103/02

(52) U.S. Cl. ..... 106/209.1; 106/214.2; 106/215.2; 106/216.1; 524/50; 162/164.7; 162/168.7; 162/169; 162/172; 162/175

(58) Field of Search ..... 106/209.1, 214.2, 106/215.2, 216.1; 524/50; 162/164.7, 168.7, 169, 172, 175

(56) References Cited

U.S. PATENT DOCUMENTS

| | | | | |
|---|---|---|---|---|
| Re. 29,960 | | 4/1979 | Mazzarella et al. | 162/158 |
| 4,214,948 | | 7/1980 | Mazzarella et al. | 162/158 |
| 5,483,078 | | 1/1996 | Hermann et al. | 250/559.32 |
| 5,595,631 | | 1/1997 | Tsai et al. | 162/175 |
| 5,876,562 | | 3/1999 | Johansson | 162/158 |
| 6,074,468 | * | 6/2000 | Bates et al. | 106/145.1 |
| 6,090,884 | * | 7/2000 | Hurley et al. | 524/734 |

* cited by examiner

*Primary Examiner*—David Brunsman
(74) *Attorney, Agent, or Firm*—Pennie & Edmonds LLP

(57) ABSTRACT

The present invention is directed to paper sizing emulsions, a method of making sizing emulsions, a method of sizing paper products, such as paper and board, and paper or board made using the method and the sizing emulsions of the invention. The paper sizing emulsions of the invention contains at least one sizing agent and a cationic liquid hydroxyalkylated starch that is pumpable and at least partially degraded. Typically, before dilution for mixing with the sizing material, the starch exists as a liquid in water and contains solids in an amount up to about 30 percent by weight, and has a viscosity of up to about 30,000 cps. The starch is diluted with water, before emulsifying the sizing agent to reduce the solids to an amount suitable for emulsification, and used to emulsify the sizing agent. The resulting emulsion can then be used to size paper and board.

37 Claims, No Drawings

USE OF HYDROXYALKYLATED STARCHES FOR IMPROVED EMULSIFICATION OF SIZING AGENTS

FIELD OF THE INVENTION

The present invention relates to emulsions for sizing paper products and to liquid cationic starches for forming such emulsions. In particular, the invention relates to emulsions for sizing paper that comprise a sizing agent and a pumpable liquid hydroxyalkylated cationic starch that is at least partially degraded, to a method of sizing paper products, and to paper products made with the method of the invention.

BACKGROUND OF THE INVENTION

Aqueous dispersions of cellulose-reactive sizing agents, such as, for example, alkenyl succinic anhydride ("ASA") and alkyl ketene dimer ("AKD"), are typically used for sizing paper products to impart hydrophobic properties to the paper. The sizing agents arc introduced during the paper making process at the wet end, and, thus, small sized particles of the sizing agents must be uniformly dispersed throughout the fiber slurry to maximize the sizing effect. Typically, improved emulsification performance of sizing agents, is judged by the median particle size of the emulsion, as a smaller particle provides better sizing and is more efficient, requiring less material, which lowers cost. Therefore, sizing agents are typically added in the form of an aqueous emulsion that includes an emulsifying agent that reduces agglomeration and separation. Typical emulsifying agents include, for example, cationic and ordinary starches, carboxymethyl cellulose, natural gums, gelatin, cationic polymers, and vinyl alcohol. The use of such emulsifiers, which may be used with or without surfactants, requires the use of relatively complex equipment that is capable of exerting at least one of high shear and high pressure to provide the homogenization required to form the desired emulsion.

ASA in particular is very widely used sizing agent in alkaline fine paper, but is very reactive, and not chemically or physically stable when stored for an extensive period of time. It must therefore be emulsified on-site with a cationic emulsifier.

Paper mills equipped with on-site cooking equipment for cooking starch typically use a starch that is shipped as a dry solid, which is cooked on-site, diluted, and mixed with ASA just prior to being introduced into the paper making process as a stable emulsion. Thus, in such mills, ASA is typically emulsified immediately before use, and fed directly to the paper machine. Cationic starches that are cooked on site have been used very successfully to emulsify ASA, stabilize the ASA emulsion particles, and help to retain them on negatively charged cellulose fibers and other furnish components. As the use of ASA is expanded in board mills, which produce such products as linerboard, gypsum board, white top board, and are typically not equipped with starch cookers, the availability of a ready-to-use emulsifier for ASA is necessary, as ASA emulsions are unstable over time, and will separate and hydrolyze if formed and shipped from off-site. Such plants require a pumpable liquid cationic emulsifying and stabilizing agent that can be mixed with ASA on-site without cooking. In addition, even mills other than board mills can benefit from a ready-to-use starch emulsion that is in liquid form.

There are relatively few liquid starches commercially available. One such cationic liquid starch is REDISIZE 132, available from National Starch, but it is not as efficient as would be desirable, and, thus, larger amounts are needed to provide sufficient sizing. While high solids of the liquid starch is desirable to minimize shipping costs, once the starch is diluted for emulsification, it is then desirable to use as little starch as possible. However, such starches are often not suitable for ASA emulsification at lower solids, i.e., below about 7%. As a result, such starches are used at higher solids, which requires higher starch consumption and higher costs to the customer. Therefore, a need exists for a liquid starch that can provide a good quality emulsion of ASA and other sizing agents at lower starch solids, i.e., below about 7%, which would provide a low starch to size ratio and a small particle size emulsion, and provide better and/or more efficient sizing.

Moreover, where cooked starches and hydrocolloids are used, in addition to the elevated temperatures required for cooking, high shear and/or high pressure are required to form the emulsion. As a result of the complicated procedures and equipment required, problems with the deposition of the sizing emulsion in the paper system, quality control, and generally unsatisfactory results often occur.

Various attempts have been made to improve sizing emulsions. For example, U.S. Pat. Nos. 4,214,948 and RE 29,960 to Mazzarrilla, et al. disclose the internal sizing of paper with a sizing emulsion consisting essentially of a substituted cyclic dicarboxylic acid anhydride or a higher organic ketene dimer and a polyoxyalkylene alkyl or polyoxyalkylene alkyl-aryl ether or the corresponding mono- or diester.

U.S. Pat. No. 5,876,562 to Johansson discloses a sizing dispersion of a cellulose-reactive sizing agent and colloidal anionic aluminum modified silica-based particles.

U.S. Pat. No. 5,595,631 to Tsai et al. discloses a method of sizing paper products using a size composition comprising an aqueous dispersion of a cyclic dicarboxylic acid anhydride containing hydrophobic substitution and a dry, cationic, non-degraded starch that is modified with either an ether group or an ester group.

However, a need remains in the art for sizing emulsions having improved emulsion quality, sizing performance, and operability, which do not require cooking at the mill. The present invention provides such a sizing emulsion. The teachings of all patents and other literature articles referenced herein are incorporated herein by reference to the extent necessary to supplement this specification.

SUMMARY OF THE INVENTION

The present invention is directed to paper sizing emulsions, a method of making sizing emulsions, a method of sizing paper products, such as paper and board, and paper or board made using the method and the sizing emulsions of the invention. The paper sizing emulsions of the invention comprise at least one sizing agent and a cationic liquid hydroxyalkylated starch that is pumpable and at least partially degraded. Typically, before dilution for mixing with the sizing agent, the starch exists as a liquid in water and contains solids in an amount up to about 30 percent by weight, preferably, from about 20 percent to about 30 percent by weight solids, and has a viscosity of up to about 30,000 cps to reduce transportation costs. The starch is then diluted with water, to form a diluted starch comprising from about 5 to about 10 percent by weight solids, and having a viscosity of from about 100 to about 1000 cps, before emulsifying the size, to reduce the solids to an amount suitable for emulsification, and used to emulsify a sizing agent. Typically, the starch and sizing agent are present in a starch to size ratio of from about 0.1:1 to about 6:1, preferably, from about 0.2:1 to about 1:1. Typically, starch solids are reduced to about 5 to about 10 percent, based on the total starch solution. The starch contains hydroxyalkyl, hydroxy terminated alkyloxy, and cationic pendant groups, where the hydroxyalkyl pendant groups contain alkyl groups having from 1 to about 20 carbon atoms, and, preferably, is a hydroxyethylated or a hydroxypropylated starch. Where the starch is a hydroxypropylated starch, the hydroxypropylation substitution is typically about 1 to about 5 percent by weight, preferably on the order of about 1.4 to about 3 percent, and the starch has a cationic substitution of generally from 0.15 to about 0.4.

Useful sizing agents include rosin, waxes, alkenyl succinic anhydrides, alkyl and alkenyl ketene dimers, isocyanate derivatives, fatty acid complexes, fluorocarbons, styrene-maleic anhydride copolymers, and substituted cyclic dicarboxylic acid anhydrides. Preferably the sizing agent is selected from the group consisting of rosin, alkenyl succinic anhydrides, and alkyl and alkenyl ketene dimers. The starch and the sizing agent are present in a starch/sizing agent ratio of from about 0.05:1 to about 5:1 and the sizing agent is present generally in an amount of from about 0.1 to about 50 percent by weight.

The invention is also directed to a method for sizing paper products, where the method comprises forming the sizing emulsion of the invention by mixing a sizing agent with a cationic liquid hydroxyalkylated starch that is pumpable and at least partially degraded, forming a web from a paper stock, and dispersing the sizing emulsion throughout the paper stock to form a sized paper product.

Starches useful in the invention are pumpable liquid cationic starches that provide smaller particle sizes in size emulsions that, in turn, provide more efficient sizing. The term pumpable is used herein to generally describe a starch that provides smaller emulsion particle size which leads to more efficient sizing, i.e, a starch that has less than about 30,000cps (as measured using a Brookfield DV-II) at starch solids ranging from about 20% to about 30% prior to dilution with water for emulsification. Such pumpable starches are easily handled with conventional paper mill pumping equipment, and remain stable, as liquids, for a long period of time, e.g., for about thirty days, i.e., about one month, preferably for about three months, and, more preferably, for about nine months. In addition the starches used for the subject invention are at least partially degraded in order that the starch has a viscosity that allows the starch to be supplied as a high solids liquid. The starches have a molecular weight that is reduced by any means known in the art, and characterized by an about 0.15 to about 0.4 percent cationic substitution and from about 1 to about 5 percent hydroxyalkylation. The pumpable liquid cationic starch of the invention typically comprises up to about 30 weight percent solids, and has a viscosity of up to about 30,000 cps prior to dilution, and contains hydroxyalkyl, hydroxy terminated alkyloxy, and cationic pendant groups, where the hydroxyalkyl pendant groups contain alkyl groups having from 1 to about 20 carbon atoms. Where the starch is a hydroxypropylated starch, the hydroxypropylation substitution preferably is about 1.4 to about 3 percent, and the starch preferably has a cationic substitution of about 0.15 to about 0.4 percent nitrogen. The pumpable liquid cationic starch of the invention may be an amylose containing starch, typically having at least 5% amylose content. The pumpable liquid cationic starch may be formed from potato starch, corn starch, tapioca starch, wheat starch, rice starch waxy maize starch, and yellow dent corn starch.

The invention is further directed to a method of forming a sizing emulsion, where the method comprises emulsifying a sizing agent in a cationic liquid hydroxyalkylated starch, wherein the starch is pumpable and at least partially degraded, as described above.

The invention is further directed to a paper or board that is treated with a sizing composition of the invention. The sizing composition is typically applied to the paper or board in an amount sufficient to provide a sizing response of at least about 10 second ink hold out, and is typically present in the paper or board in an amount of from about 0.5 to about 20 pounds of size per ton of paper or board.

DETAILED DESCRIPTION OF THE INVENTION

As used herein, the term "pumpable liquid starch" refers to a starch solution having a viscosity and a solids content that allow the starch solution to be pumped using conventional paper mill pumping equipment. Typically, a pumpable liquid starch has a viscosity of no more than about 30,000 cps, as measured on a Brookfield viscometer model no. DV-II with spindle no. 2 at 10 rpm at room temperature. In addition, as used herein, the term "at least partially degraded" refers to a starch in which the molecular weight has been reduced by any means known in the art, and, typically, by at least one of oxidation, hydrolysis, or enzymatic degradation.

The present invention is directed to emulsions for sizing paper products, to liquid cationic starches for forming such emulsions, to a method of sizing paper products, and to paper and board formed using the method or the emulsion of the invention. The emulsions of the invention may be used to size paper and paperboard products including, but not limited to linerboard, corrugating medium, fluting medium, box board, OCC linerboard, gypsum wall board, construction board, saturating paper and board, neutral fine paper, alkaline fine paper, acid fine paper, and non-woven paper.

The sizing emulsions of the invention comprise a sizing agent, and a pumpable liquid, cationic hydroxyalkylated starch that is at least partially degraded. Useful sizing agents include, but are not limited to rosin, waxes, ketene dimers, isocyanate derivatives, fatty acid complexes, fluorocarbons, styrene-acrylate copolymers, styrene-acrylic copolymers, styrene-maleic anhydride copolymers, and substituted cyclic dicarboxylic acid anhydrides. Preferred sizing agents include alkenyl succinic anhydride ("ASA"), alkyl and alkenyl ketene dimers ("AKD"), and rosin. Most preferred are ASA and AKD having alkyl or alkenyl groups comprising from about 15 to about 36 carbon atoms.

The base starch material used in preparing a pumpable liquid cationic starch useful in the invention may be any of the native starches, including amylose and non-amylose containing starches. Pumpable liquid, cationic hydroxyalkylated starches useful in the invention may be obtained using, for example, potato starch, corn starch, tapioca starch, wheat starch, rice starch waxy maize starch, and yellow dent corn starch, The starch is modified to contain hydroxyalkyl, hydroxy terminated alkyloxy, and cationic pendant groups, and is at least partially degraded. Preferably, the hydroxyalkyl pendant groups contain alkyl groups having from 1 to about 20 carbon atoms, and, more preferably, from 1 to about 5 carbon atoms.

Typically, the ratio of pumpable liquid cationic hydroxyalkylated starch to sizing agent in the emulsion ranges from about 0.05 to 1 to about 10 to 1, preferably about 0.1 to 1 to about 6 to 1, and more preferably from about 0.2 to 1 to about 1 to 1. When a typical application dose of 1–5lb. size per ton of paper is contacted with a paper pulp, and used to form a paper sheet, the emulsion of the invention provides a sizing response of at least about 10 seconds ink hold out, as determined by an ink penetrometer, as described later herein. Typically, to size paper, the sizing emulsion is used in an amount of from about 0.5 to about 20 pounds of size per ton of paper, preferably, from about 1 to 10 pounds per ton of paper.

The hydroxy terminated alkyloxy pendant groups may be obtained by reacting the starch with an alkylene oxide, such as ethylene oxide or propylene oxide, and produces a modified starch having substantially the same number of hydroxyl groups as were present in the original non-modified starch. Typically, the cationic groups comprise trialkylammonium and tetraalkylammonium salts. Starches useful in the invention may contain a small amount of anionic carboxyl groups provided that the net charge of the starch is cationic. The preferred starches are pumpable liquid cationic hydroxyethylated and hydroxypropylated starches, preferably having a viscosity of no more than about 30,000 cps at 20 to 30 percent solids as measured on a Brookfield viscometer model no. DV-II with spindle no. 2 at 30 rpm at room temperature, and are available from Penford Products Company of Cedar Rapids, Iowa. The most preferred starch is the pumpable liquid cationic hydroxypropylated starch. The molecular weight of the starch is typically reduced, allowing ready dispersal at high solids , e.g., from about 20 to about 30 percent, and the starch is made cationic. The hydroxypropyl substitution provides additional reactive sites for the starch to bind onto cellulose, and dual derivatization with cationic and hydroxypropyl pendant groups provides a stable starch dispersion. Where the starch is not derivatized, it will retrograde, forming hydrogen-bonds, resulting in a gel that is eventually insoluble in water. For ASA emulsification, the additional hydroxypropyl substitution of the starch aids in its dispersion.

The pumpable liquid hydroxyalkylated starches useful in the invention, in particular the hydroxypropylated cationic starch, provide improved sizing emulsion quality at lower starch solids, particularly with rosin, ASA, and AKD. Starch samples were tested at various levels of solids, and compared to a commercially available liquid non-hydroxy substituted cationic starch, i.e., REDISIZE 132. Samples at different levels of molecular weight reduction and, consequently, different viscosity have shown improved emulsification performance over REDISIZE 132 starch. Typically, as discussed above, improved emulsification performance of sizing agents, is judged by the median particle size of the emulsion. Smaller median particle size emulsions exhibit improved physical stability, and provide more fiber coverage due to increased surface area. Such performance improvement is obtained with emulsions comprising the pumpable liquid cationic hydroxyalkylated starch of the present invention when compared to conventional cationic starch. Typically, the median particle size for the emulsions of the invention range less than about 1.0 micron, usually from about 0.2 to about 0.9$\mu$m, preferably, 0.2 to about 0.8$\mu$m. The starch size emulsions of the subject invention exhibit good particle size stability, such that the small particles size is maintained and no agglomeration occurs, e.g., as demonstrated by a one hour particle size stability measurement.

Typically, the degree of hydroxyalkyl substitution of the starch is as high as possible, generally on the order of about 1 to about 5, preferably on the order of about 1.4 to about 3 percent hydroxypropylation (PO) based on the weight of the starch and the cationic substitution is generally on the order of about 0.15 to about 0.4 percent nitrogen, based on the total weight of the starch. The cationic substitution should be at least about 0.3 percent nitrogen or higher. However, for paper products used as food containers in the United States, the Food and Drug Administration has set an upper limit, and, thus, for those applications the cationic substitution is typically no more than about 0.40 percent nitrogen, based on total starch. Overall, the amount of cationic substitution will range from about 0.25 to about 0.4 nitrogen in most applications, but may be higher in some applications.

The viscosity (as measured using a Brookfield DV-II, Spindle #2, 30 rpm) of the diluted starch should be at least about 100 cps, preferably at least about 200 cps at 5% starch solids in order to provide the proper emulsification of the sizing agent. Preferably, the diluted starch has a viscosity of from about 100 to about 1000 cps, at about 5 to about 10 percent starch solids. At a lower viscosity, the starch usually lacks the ability to properly coat the sizing agent, and make a good emulsion. While any native starch may be used in this invention, it is important that the starch is at least partially degraded to provide a liquid starch that does not require cooking for use. The viscosity as used herein is a Brookfield viscosity measured using a Brookfield viscometer model no. DV-II with spindle no. 2 at 30 rpm.

The current industry standard for sizing agent emulsification is the use of a Burks pump to disperse the sizing agent in the starch. The emulsification parameters are narrow in creating a good emulsion quality, such that in order to obtain a good emulsion quality, the number of times that the emulsion is recycled through the pump is kept constant by keeping a constant flow rate, regardless of changes in the flow of the sizing agent. For smaller paper machines, requiring lower levels of sizing agent, feeding starch at the established flow rate and higher starch solids, provides a starch addition at unnecessarily high dosage level. However, the emulsification of a sizing agent in a pumpable liquid cationic hydroxyalkylated starch, preferably ASA in hydroxypropylated cationic starch, at starch solids of as low as 5%, broadens the starch to size ratio. Therefore, with current equipment, the starch to size ratio typically ranges from about 0.1 to 1 to about 6 to 1, preferably from about 0.2 to 1 to about 1 to 1. This emulsion may be formed using any emulsification procedure and system known in the art, including industrial size, low and high pressure units, such as Cytec low pressure turbine emulsifiers supplied by Cytec Industries Inc, Nalco high pressure emulsifier systems, and National Starch turbine and venturi emulsifiers.

The sizing emulsion will contain the pumpable liquid cationic hydroxypropylated starch and sizing compound in a sufficient quantity of water to provide the desired concentration of the sizing compound. Thus, the amount of the sizing compound, e.g., rosin, ASA, or AKD, in the emulsion will be sufficient if it is at a concentration of from about 0.5 to 50%, preferably 1 to 20% by weight, and most preferably from about 3 to about 5 percent.

The resulting emulsion can simply be added to the wet end of a paper making machine or to a stock preparation system to provide a concentration of the sizing agent of from about 0.01 to 2% and preferably about 0.1 to 0.5% by weight, based on dry fiber weight to the paper or board. The precise amount of size used will depend upon the type of pulp being treated, the specific operating conditions, and the particular end use of the paper product. For example, paper which will require good water resistance or ink holdout will require a higher concentration of size than paper used in applications where those properties are not as critical.

Alternatively, the size emulsion, in the concentrations discussed above, may be sprayed or coated onto the surface of the formed web at any point prior to the final drying step to provide the required size concentration.

The size emulsions are generally not limited to any particular pH range, and may be used in the treatment of any of neutral, alkaline, and acidic pulp. The size emulsions may thus be used in combination with alum and promoters, including polyaluminum chloride and polyaluminum sulfate silicate which are very commonly used in making paper, as well as other acid materials. They may also be used with calcium carbonate or other alkaline materials in the stock. The preferred pH of paper pulp can vary, depending upon the size used. For example, ASA emulsified with the starch in accordance with this invention may preferably be used at a pH range of from about 4 to about 9, preferably from about 6 to about 8.

Subsequent to the addition of the size emulsion to the pulp slurry, the web is formed, pressed and dried on the paper making machine in the usual manner. In actual paper machine operations, full sizing using ASA is generally achieved upon completion of the drying process. Because of limited drying in laboratory procedures however, further improvements in the water resistance of the paper prepared with the size compositions of this invention may be obtained by curing the resulting webs, sheets, or molded products. The post-curing process generally involves heating the paper at temperatures in the range of from about 80 to about 125° C. for a period of from about 1 to 60 minutes. For sizing agents other than ASA, generally longer cure times may be required.

The size emulsions of the present invention may be successfully utilized for the sizing of paper and paperboard prepared from all types of both cellulosic and combinations of cellulosic with non-cellulosic fiber. Also included are sheet-like masses and molded products prepared from combinations of cellulosic and non-cellulosic materials derived from synthetics such as polyamide, polyester and polyacrylic resin fibers as well as from mineral fibers such as asbestos and glass. The hardwood or softwood cellulosic fibers which may be used include bleached and unbleached sulfate (Kraft), bleached and unbleached sulfite, bleached and unbleached soda, neutral sulfite, semi-chemical, groundwood, chemi-groundwood, and any combination of these fibers. In addition, synthetic cellulosic fibers of the viscose rayon or regenerated cellulose type can also be used, as well as recycled waste papers from various sources.

All types of pigments and fillers may be added in the usual manner to the paper product which is to be sized. Such materials include clay, talc, titanium dioxide, calcium carbonate, calcium sulfate and diatomaceous earths. Stock additives, such as defoamers, pitch dispersants, slimicides, etc. as well as other sizing compounds, can also be used with the size mixtures described herein.

As noted above, the size compositions described herein, when emulsified and used in the paper stock system, yield paper products having superior sizing properties, as demonstrated by the following examples. The following examples will further illustrate the embodiments of the present invention. In these examples, all parts given are by weight unless otherwise specified. However, the following non-limiting examples are merely illustrative of the preferred embodiments of the present invention, and are not to be construed as limiting the invention, the scope of which is defined by the appended claims.

EXAMPLES

Unless otherwise noted, all of the liquid starches used in the following examples were provided by Penford Products Company of Cedar Rapids, Iowa, and are available under the tradename Liquisize™.

Example 1

Cationic hydroxypropylated potato starch was used in the emulsification and promotion of alkenyl succinic anhydride size ("ASA"). The viscosity of the starch was 24,700 cps at 25.9 percent starch solids ("solids"), as measured with a Brookfield DV-II, spindle no. 2, at 10 rpm and 20.4° C. This starch is referred herein as Starch A. Starch A was diluted to 10 percent solids with deionized water for use, and had a viscosity of 295 cps. A Waring standard blender was used for emulsification of ASA in an aqueous solution of Starch A. An ASA emulsion of 1/1 by weight starch to size ratio was prepared, where 18.2 grams of ASA were charged into 181.8 grams of the 10 percent solution of Starch A, which was weighed out in a blender jar. The blender was then quickly switched to high shear to produce a well-dispersed emulsion. Aliquots of the emulsion were obtained after 30 and 60 seconds of high shear emulsification.

The Starch A/ASA emulsion, prepared after 60 seconds of emulsification, was then used in making paper to evaluate its sizing efficiency. The dosage amount of Starch A/ASA emulsion added to the paper pulp was 2.5 pounds of ASA size per ton of paper pulp. Typical handsheet sizing experiments were completed using the following procedure. A 50/50 mixture of bleached hardwood and softwood kraft pulp was beaten to a Canadian Standard Freeness of 500 ml to which 20 percent by weight of precipitated calcium carbonate filler (ALBACAR® 5970) was added, and the pH was adjusted to 7.8. While stirring, a batch of 0.5 percent consistency stock containing 10 grams of fiber was treated with the Starch A/ASA emulsion in an amount sufficient to provide 2.5 pounds of ASA per ton of dry fiber, as described above, and followed by the addition of 1.0 lb/ton of ACCURAC® 171, an anionic polyacrylamide retention aid. One minute of stirring for the ASA emulsion and 15 seconds of stirring for the retention aid was allowed, respectively. From each 10 gram batch, three 2.8-gram handsheets (50-lb/TAPPI ream) were formed using a Noble and Wood handsheet former, pressed using 15 psig pressure, and drum dried at 240° F. for 30 seconds.

Example 2

The cationic hydroxypropylated potato starch of Example 1 was used, except that the starch was degraded to a viscosity of 4,450 cps at 20.9 percent solids (Brookfield DV-II, spindle 2, 10 rpm, 33° C.). This starch is referred herein as Starch B. Starch B was diluted to 10 percent solids with deionized water and had a viscosity of 345 cps before it was used to emulsify ASA in the manner described in Example 1. On equal basis, Starch B was of relatively higher viscosity than Starch A, as shown in Table 1.

Example 3

The Starch/size emulsions prepared in Examples 1 and 2 were compared on a particle size basis and for size performance to a commercially available non-hydroxypropylated cationic liquid starch sold commercially as REDISIZE 132, available from National Starch. Volume average emulsion particle size was measured using a HORIBA LA-700 Laser Scattering Particle Size Distribution Analyzer. Size performance was measured by assessing the degree of ink penetration through conditioned paper sheets (23° C. and 50 percent relative humidity) using a sizing test of the type described in TAPPI Standard T-530 pm-83, but using an ink penetrometer, as described in U.S. Pat. No. 5,483,078. This test measures the elapsed time after contacting one side of the paper with ink for the reflectance of the opposite side to fall to 80 percent of its initial value. The ink used was the same as described in T-530 pm-83, but contained no formic acid and was buffered to pH 7. The tests were normalized to 50 lb/TAPPI ream basis weight. Higher ink penetration values are indicative of better sizing efficiency. As it is known in the art that smaller emulsion particle sizes tend to provide improved emulsification processing and improved sizing performance over larger particle sizes, the results, set forth in Table 1, demonstrate that the hydroxypropylated cationic starches of the instant invention provide improved emulsification performance and processing when compared on an equal solids basis. As it is known that emulsion quality and size retention are generally affected by the starch viscosity, the small particle sizes obtained from the starch/size emulsions in Examples 1 and 2 of the instant invention were unexpected in view of their relatively low starch viscosity, given that higher viscosity is generally associated with better emulsification performance (i.e., smaller particle size).

TABLE 1

Emulsion Quality Comparison of ASA Size in Starch Emulsifier by Emulsion Particle Size and Sizing Performance

| Starch | Example | Starch Solids (%) | Starch Viscosity** (cps) | Starch/ Size Ratio | Blender Time 30 sec Particle Size (μm) | Blender Time 60 sec Particle Size (μm) | ASA dosage (lb/ton) 2.0 Ink penetration (sec) | ASA dosage (lb/ton) 2.5 Ink penetration (sec) |
|---|---|---|---|---|---|---|---|---|
| A | 1 | 10 | 295 | 1/1 | 0.43 | 0.39 | 36 | 178 |
| B | 2 | 10 | 345 | 1/1 | 0.41 | 0.33 | 44 | 167 |
| REDISIZE | * | 10 | 490 | 1/1 | 0.46 | 0.40 | 40 | 155 |

*Comparative
**Brookfield DV-II, spindle 2, 30 rpm, 23° C.

Examples 4 & 5

Large-scale emulsification of ASA in hydroxypropylated cationic Starch A and B, prepared in a manner similar to that of Examples 1 and 2, was compared to that in REDISIZE 132 starch to show the benefits of the hydroxypropyl substitution in improving ASA emulsion quality. In large-scale emulsification, an A.C.E. 400 unit, available from Cytec Industries Inc., was used. Starch A and B, and REDISIZE 132, described in Examples 1 and 2, and the REDISIZE 132, as described in Example 3, were diluted to approximately 5 percent solids immediately prior to emulsification. A standard Cytec A.C.E. 400 emulsification procedure was followed, where a constant starch flow through a Burks turbine pump was maintained and the ASA was introduced just prior to the pump at a given flow rate, as described by C. E. Farley and R. B. Wasser, "Sizing with Alkenyl Succinic Anhydride", chapter 3, The Sizing of Paper, 2$^{nd}$ edition, Walter F. Reynolds, ed., TAPPI, Atlanta, Ga. (1989). Constant recirculation through the pump was maintained so that the outlet pump pressure was 160 psi and pressure increase through the pump was 150 psi. Emulsion aliquots from the A.C.E. 400 effluent were obtained after 5 minutes of emulsification under constant conditions. Emulsion particle size was checked as described in Example 3. The results, which are set forth in Table 2, show improved performance with the hydroxypropylated starches over the higher viscosity REDISIZE 132 starch as indicated by smaller particle size of the Starch A and B emulsions.

TABLE 2

Performance Comparison between Starch A and B, and REDISIZE 132 per Emulsion Quality

| Starch | Example | Starch Solids (%) | Starch Flow (gpm) | ASA Flow (lb/hr) | Starch/ Size (ratio) | Typical Emulsion Particle Size Results (μm) |
|---|---|---|---|---|---|---|
| A | 4 | 4.8 | 1 | 50 | 0.5/1 | 0.77 |
| B | 5 | 5.2 | 1 | 50 | 0.5/1 | 0.62 |
| REDISIZE | * | 4.9 | 1 | 50 | 0.5/1 | 0.89 |

*Comparative

Example 6

The cationic hydroxypropylated starch of Example 1 was used, except that it was degraded to a final viscosity of 7,900 cps at 20.7 percent solids (Brookfield DV-II, spindle 4, 30 rpm, 19° C.). The starch is herein called Starch C. Starch C was diluted to 10 percent solids, and used to form an ASA emulsion as described in Example 1, except that longer total emulsification blender time was used. Thus, aliquots at 30, 60, 120 and 240 seconds of blender time were obtained.

Example 7

The procedure of Example 6 was followed to prepare an emulsion of ASA in Starch C except that Starch C was diluted to 5 percent solids with deionized water prior to use in emulsification.

Example 8

The cationic hydroxypropylated starch of Example 1 was used, except that the starch was degraded to a final viscosity of 12,500 cps at 21.3 percent solids (Brookfield DV-II, spindle 4, 30 rpm, 19° C.). This starch is herein called Starch D. This starch was diluted to 10 percent solids prior to emulsification with ASA.

Example 9

The ASA in starch emulsion preparation procedure as outlined in Example 8 was followed, except that Starch D was diluted to 5 percent starch solids for emulsification of ASA.

Example 10

The starch/size emulsions prepared in Examples 6 to 9 were compared on a particle size basis using blender emulsification procedure outlined in Example 3. The results set forth in Table 3 show that an improved, smaller particle size is obtained with shorter emulsification time for the hydroxypropylated cationic starches of the present invention when compared to conventional starch. An improved particle size was obtained with emulsification time with Starch C and D as compared to REDISIZE 132, as set forth in Table 3. This improvement shows a benefit of a hydroxypropylated starch of similar viscosity as the non-hydroxypropylated starch in providing a vastly smaller ASA emulsion particle size than that which can be obtained with the non-hydroxyalkylated starch such as REDISIZE 132. Moreover, the results show that a relatively low-viscosity hydroxypropylated Starch C can provide particle size approximately equal to its higher-viscosity counterpart, Starch D.

TABLE 3

Performance Comparison between Starch C and D, and REDISIZE per Waring Blender Emulsion Quality

| Starch | Example | Starch Solids (%) | Starch Viscosity** (cps) | Starch/ ASA Size | Blender Time 30 sec | 60 sec | 120 sec | 240 sec |
|---|---|---|---|---|---|---|---|---|
| | | | | | Emulsion Median Particle Size (microns) | | | |
| C | 6 | 10 | 560 | 1/1 | 1.33 | 0.97 | 0.69 | 0.52 |
| C | 7 | 5 | 120 | 0.25/1 | 1.29 | 1.02 | 0.76 | 0.57 |
| D | 8 | 10 | 810 | 1/1 | 1.31 | 0.96 | 0.74 | 0.54 |
| D | 9 | 5 | 200 | 0.25/1 | 1.31 | 0.96 | 0.74 | 0.54 |
| REDISIZE | * | 10 | 490 | 1/1 | 2.37 | 1.93 | 1.53 | 0.97 |
| REDISIZE | * | 5 | 135 | 0.25/1 | 2.37 | 2.23 | 1.54 | 0.89 |

*Comparative
**Brookfield DV-II, spindle #2, 30 rpm, 23° C.

Example 11 12, 13, and 14

These examples illustrate an improved emulsification performance of Starch D as compared to REDISIZE starch at ambient starch pH, i.e., the normal pH of the starch solution, and at reduced starch pH of 4. Starch D is the same one as described in Example 10. The same emulsification procedure as detailed in Example 1 was followed herein, with the exception that 5 percent starch solids were used to obtain a 1 to 1 starch to size ratio. Thus, 9.09 grams of ASA were added to 181.8 grams of starch solution to obtain a 1/1 starch to size ratio. The results, set forth in Table 4, show significantly improved performance with the hydroxypropylated Starch D over REDISIZE starch at ambient and reduced starch pH. It is well known in the art that alkenyl succinic anhydride size readily reacts with water. A reduced starch pH of about 4 is often used for ASA emulsification to retard this hydrolysis reaction. The improved emulsification and size performance of a starch at ambient as well as a reduced starch pH is demonstrated.

TABLE 4

Performance Comparison between Starch D and REDISIZE 132 at 5% Starch Solids, at Ambient and Reduced Starch pH per Emulsion Quality Analysis

| Starch | Example | Starch pH | Starch/ Size | Emulsion Median Particle Size (microns) 30 sec | 60 sec | 120 sec | 240 sec |
|---|---|---|---|---|---|---|---|
| D | 11 | ambient | 1/1 | 1.48 | 1.32 | 1.04 | 0.57 |
| REDISIZE | * | ambient | 1/1 | 2.79 | 2.11 | 1.32 | 1.30 |
| D | 12 | 4 | 1/1 | 1.75 | 1.05 | 0.79 | 0.55 |
| REDISIZE | * | 4 | 1/1 | 2.12 | 1.75 | 1.34 | 0.93 |

TABLE 4-continued

Performance Comparison between Starch D and REDISIZE 132 at 5% Starch Solids, at Ambient and Reduced Starch pH per Emulsion Quality Analysis

| Starch | Example | Starch pH | Starch/ Size | Emulsion Median Particle Size (microns) 30 sec | 60 sec | 120 sec | 240 sec |
|---|---|---|---|---|---|---|---|
| D | 13 | ambient | 0.25 | 1.14 | 1.01 | 0.82 | 0.58 |
| REDISIZE | * | ambient | 0.25 | 2.01 | 2.03 | 1.57 | 0.90 |

TABLE 4-continued

Performance Comparison between Starch D and REDISIZE 132 at 5% Starch Solids, at Ambient and Reduced Starch pH per Emulsion Quality Analysis

| Starch | Example | Starch pH | Starch/ Size | Emulsion Median Particle Size (microns) 30 sec | 60 sec | 120 sec | 240 sec |
|---|---|---|---|---|---|---|---|
| D | 14 | 4 | 0.25/1 | 1.14 | 0.90 | 0.72 | 0.51 |
| REDISIZE | * | 4 | 0.25/1 | 2.35 | 1.39 | 1.37 | 0.76 |

*Comparative

Starch D was also used to evaluate ASA sizing performance, and compared to REDISIZE 132. Emulsions at 5 percent starch solids and reduced pH of 4 were prepared as outlined in Examples 12 and 14. A 90-second blender emulsification time was used. The handsheet making and size performance testing protocol outlined in Example 1 was followed. The results, as set forth in Table 5, show improved sizing efficiency with the hydroxypropylated cationic Starch D as compared to that with REDISIZE.

TABLE 5

Performance Comparison between Starch D and REDISIZE 132, at 5% Starch Solids and Reduced Starch pH, per Ink Penetration.

| Starch | Example | Starch/Size | Emulsion Particle Size 90 sec (microns) | 2 lb/ton ASA Typical Ink Penetration Values (seconds) | 2.5 lb/ton ASA Typical Ink Penetration Values (seconds) |
|---|---|---|---|---|---|
| D | 12 | 1/1 | 0.88 | 24 | 211 |
| REDISIZE | * | 1/1 | 1.37 | 8 | 68 |
| D | 14 | 0.25/1 | 0.72 | 93 | 90 |
| REDISIZE | * | 0.25/1 | 1.49 | 0 | 38 |

*Comparative

Example 15

The ability of a liquid hydroxyethylated cationic, partially degraded corn starch to emulsify ASA (CYTEC ACCOSIZE-18®) in board applications was tested. The starch was liquified, and then diluted down to the various solids percentages set forth in Table 6. The emulsification tests demonstrated that the liquid hydroxyethylated cationic corn starch provides good performance, as demonstrated by Table 6. All of the emulsification was performed under standard A.C.E. 400 conditions. The starch flow rate was kept constant, and the starch influent temperature was about 80° F. (26.7° C.), with a temperature rise of 20° to 30° F. (11.1° to 16.7° C.). The resulting product prepared with this starch had a low particle size, and formed emulsions that remained stable over time, e.g., a maximum of about 2 percent particle size increase after one hour.

TABLE 6

| Starch ID. | Starch Solids (%) | ASA Flow Rate (lb/hr) | Starch/Size | Emulsion Particle Size (microns) | 1-Hour Particle Size (microns) |
|---|---|---|---|---|---|
| Apollo 4280 | 13 | 12 | 5.5 | 0.61 | 0.61 |
| | 13 | 12 | | 0.56 | |
| | 13 | 25 | 2.6 | 0.60 | 0.61 |
| | 13 | 25 | | 0.60 | |
| | 10 | 12 | 4.2 | 0.86 | 0.83 |
| | 10 | 25 | 2.0 | 0.85 | 0.86 |
| | 20 | 12 | 8.2 | 0.49 | 0.50 |
| | 20 | 12 | | 0.50 | |
| | 20 | 25 | 3.9 | 0.47 | 0.48 |

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments that fall within the true spirit and scope of the present invention.

What is claimed is:

1. A paper sizing emulsion, comprising at least one sizing agent and a cationic stable liquid hydroxyalkylated starch that is pumpable and at least partially degraded.

2. The paper sizing emulsion of claim 1, wherein the starch is present in a starch to size ratio of from about 0.1:1 to about 6:1.

3. The paper sizing emulsion of claim 1, wherein the starch is present in a starch to size ratio of from about 0.2:1 to about 1:1.

4. The paper sizing emulsion of claim 1, wherein the starch contains hydroxyalkyl, hydroxy terminated alkyloxy, and cationic pendant groups, wherein the hydroxyalkyl pendant groups contain alkyl groups having from 1 to about 20 carbon atoms.

5. The paper sizing emulsion of claim 1, wherein the starch is a hydroxyethylated or a hydroxypropylated starch.

6. The paper sizing emulsion of claim 1, wherein the starch is a hydroxypropylated starch, and has a hydroxypropylation substitution of about 1 to about 5 percent, and a cationic substitution of about 0.15 to about 0.4 percent nitrogen.

7. The paper sizing emulsion of claim 6, wherein the starch has a hydroxypropylation substitution of about 1.4 to about 3 percent.

8. The paper sizing emulsion of claim 1, wherein the sizing agent is selected from the group consisting of rosin, wax emulsions, alkenyl succinic anhydrides, alkyl and alkenyl ketene dimers, isocyanate derivatives, fatty acid complexes, fluorocarbons, styrene-acrylate copolymers, styrene-acrylic copolymers, styrene-maleic anhydride copolymers, and substituted cyclic dicarboxylic acid anhydrides and mixtures thereof.

9. The paper sizing emulsion of claim 1, wherein the sizing agent comprises an alkenyl succinic anhydride.

10. The paper sizing emulsion of claim 1, wherein the sizing agent comprises an alkyl or alkenyl ketene dimer.

11. The paper sizing emulsion of claim 1, wherein the sizing agent is present in an amount of from about 0.5 to about 50 percent by weight.

12. A method for sizing paper products, the method comprising:

forming a sizing emulsion by emulsifying a sizing agent with a cationic liquid hydroxyalkylated starch that is pumpable and at least partially degraded; and dispersing the sizing emulsion throughout a paper stock to form a sized paper product.

13. The method according to claim 12, further comprising providing the starch with a viscosity of no more than 30,000 cps, and diluting the starch.

14. The method according to claim 12, further comprising providing the starch with from about 20 to about 30 percent by weight solids, and diluting the starch to form a diluted starch comprising from about 5 to about 10 percent starch solids.

15. The method according to claim 12, further comprising mixing the starch and the sizing agent in a starch to size ratio of from about 0.1:1 to about 6:1.

16. The method according to claim 12, further comprising mixing the starch and the sizing agent in a starch to size ratio of from 0.2:1 to about 1:1.

17. The method according to claim 12, further comprising selecting a starch that contains hydroxyalkyl, hydroxy terminated alkyloxy, and cationic pendant groups, and the hydroxyalkyl pendant groups contain alkyl groups having from 1 to about 20 carbon atoms.

18. The method according to claim 12, wherein the starch is a hydroxypropylated starch, and has a hydroxypropylation substitution of about 1 to about 5 percent, and a cationic substitution of about 0.15 to about 0.4 percent nitrogen.

19. The method according to claim 18, wherein the starch has a hydroxypropylation substitution of about 1.4 to about 3 percent.

20. The method according to claim 12, further comprising selecting the starch from the group consisting of potato starch, corn starch, tapioca starch, wheat starch, rice starch waxy maize starch, and yellow dent corn starch, and selecting the sizing agent from the group consisting of rosin, wax emulsions, alkenyl succinic anhydrides, alkyl and alkenyl ketene dimers, isocyanate derivatives, fatty acid complexes, fluorocarbons, styrene-acrylate copolymers, styrene-acrylic copolymers, styrene-maleic anhydride copolymers, and substituted cyclic dicarboxylic acid anhydrides.

21. The method according to claim 12, further comprising forming the sizing emulsion such that the sizing agent is present in an amount of from about 0.5 to about 50 percent by weight.

22. A paper or board, formed according to the method of claim 12.

23. A method of preparing a paper sizing emulsion, the method comprising:

emulsifying a sizing agent in a cationic liquid hydroxyalkylated starch, wherein the starch is pumpable and at least partially degraded.

24. The method of claim 23, further comprising providing the starch with a viscosity of no more than 30,000 cps, and diluting the starch.

25. The method of claim 23, further comprising providing the starch with from about 20 to about 30 percent by weight solids, and diluting the starch to form a diluted starch comprising from about 5 to about 10 percent starch solids, and a viscosity of from about 100 to about 1000 cps.

26. The method of claim 23, further comprising providing the starch with from about 20 to about 30 percent by weight solids, and diluting the starch to form a diluted starch comprising from about 5 to about 10 percent starch solids.

27. The method of claim 23, further comprising mixing the starch and the sizing agent in a starch to size ratio of from about 0.1:1 to about 6:1.

28. The method of claim 23, further comprising mixing the starch and the sizing agent in a starch to size ratio of from 0.2:1 to about 1:1.

29. The method of claim 23, further comprising selecting a starch that contains hydroxyalkyl, hydroxy terminated alkyloxy, and cationic pendant groups, and the hydroxyalkyl pendant groups contain alkyl groups having from 1 to about 20 carbon atoms.

30. The method of claim 23, wherein the starch is a hydroxypropylated starch, and has a hydroxypropylation substitution of about 1 to about 5 percent, and a cationic substitution of about 0.15 to about 0.4 percent nitrogen.

31. The method of claim 30, wherein the starch has a hydroxypropylation substitution of about 1.4 to about 3 percent.

32. The method of claim 23, further comprising selecting the starch from the group consisting of potato starch, corn starch, tapioca starch, wheat starch, rice starch waxy maize starch, and yellow dent corn starch, and selecting the sizing agent from the group consisting of rosin, wax emulsions, alkenyl succinic anhydrides, alkyl and alkenyl ketene dimers, isocyanate derivatives, fatty acid complexes, fluorocarbons, styrene-acrylate copolymers, styrene-acrylic copolymers, styrene-maleic anhydride copolymers, and substituted cyclic dicarboxylic acid anhydrides.

33. The method of claim 23, further comprising forming the sizing emulsion such that the sizing agent is present in an amount of from about 0.5 to about 50 percent by weight.

34. A paper or board, treated with a sizing composition, the sizing composition comprising at least one sizing material and a cationic liquid hydroxyalkylated starch that is pumpable and at least partially degraded.

35. The paper or board of claim 23, wherein sizing composition comprises starch solids in an amount of up to about 10 percent by weight, and the starch and sizing material are present in a starch to size ratio of about 0.1:1 to about 6:1.

36. The paper or board of claim 23, wherein sizing composition is applied to the paper or board in an amount sufficient to provide a sizing response of at least about 10 second ink hold out.

37. The paper or board of claim 23, wherein the sizing composition is present in the paper or board in an amount of from about 0.5 to about 20 pounds per ton of paper or board.

* * * * *